US006497256B1

(12) United States Patent
Adams et al.

(10) Patent No.: US 6,497,256 B1
(45) Date of Patent: Dec. 24, 2002

(54) THERMAL BARRIER FOR AIR HANDLING UNIT (AHU) CABINET

(75) Inventors: John C. Adams, Manchester, TN (US); Michael W. Austin, McMinnville, TN (US); Christian C. Herbeck, Manchester, TN (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 09/905,234

(22) Filed: Jul. 13, 2001

(51) Int. Cl.[7] ..... F16L 9/14

(52) U.S. Cl. ..... 138/149; 138/155; 138/158; 138/DIG. 4; 49/483.1; 49/489.1

(58) Field of Search ..... 138/149, 155, 138/158, DIG. 4; 49/68, 483.1, 489.1, 493.1, 496.1, 499.1; 34/242

(56) References Cited

U.S. PATENT DOCUMENTS 3,095,014 A * 6/1963 Dosker ..... 138/149
4,034,511 A * 7/1977 Bursk ..... 49/489.1
4,241,762 A * 12/1980 Link et al. ..... 138/155
4,798,917 A * 1/1989 Eiermann et al. ..... 138/149
5,107,622 A * 4/1992 Fuchs et al. ..... 49/489.1
5,289,657 A * 3/1994 Kiel ..... 49/489.1
5,450,879 A * 9/1995 Toben ..... 138/109
5,749,399 A * 5/1998 Reyes Zorrilla ..... 138/155
5,975,146 A * 11/1999 Lardillat et al. ..... 138/149

* cited by examiner

*Primary Examiner*—James Hook
(74) *Attorney, Agent, or Firm*—Wall Marjama & Bilinski LLP

(57) ABSTRACT

A panel for use in air conditioning duct for carrying air along an enclosed path of travel. The panel includes a rectangular shaped frame made of a material having a relatively high R value. The frame is closed by a top cover and a bottom cover so that a cavity is established within the panel. The cavity is filled with a curable material that sets inside the panel to bond the walls of the frame together and to bond the covers to the frame. A bulb seal having high insulation characteristics extending along the length of one edge of adjoining panels so that energy transmission is further inhibited.

24 Claims, 7 Drawing Sheets

THERMAL BARRIER FOR AIR HANDLING UNIT (AHU) CABINET

FIELD OF THE INVENTION

This invention relates generally to a panel for use in an air handling unit that forms a thermal barrier to limit the flow of energy through the panel.

BACKGROUND OF THE INVENTION

Many air handling units found in the prior art are simply fabricated from sheet metal ducts that are connected together in the field to establish an enclosed flow path, through which air is conducted. The sheet metal walls of the ducts readily conduct heat and provide little in the way of a thermal barrier such that energy readily flows into or out of the ducts. When the air handling unit is carrying relatively cooled, conditioned air, this flow of energy into or out of the ducts can be costly and places an unwanted load on the air conditioning equipment.

In addition, when the air handling unit is installed in an unconditioned space and is carrying cooled air, the outer casing of the unit will "sweat" due to condensation of water vapor in the relatively hot outside air upon contact with the casing. The moisture so developed will run off the unit onto the floor or onto equipment contained in the unconditioned space. Such run off creates a safety hazard for people working in the area and can damage the equipment.

SUMMARY OF THE INVENTION

It is an object of the present invention to improve ducts for conducting air along a desired flow path.

A further object of the present invention is to limit the loss of energy through the walls of a duct carrying conditioned air.

A still further object of the present invention is to provide an improved panel for use in an air handling unit.

Another object of the present invention is to provide a structural panel for use in an air handling unit that has a relatively high R value.

Yet another object of the present invention is to prevent ducts of an air handling unit from sweating when carrying conditioned air.

These and other objects of the present invention are contained by a panel suitable for use in an air handling duct for carrying air along an enclosed path of travel. The panel includes a rectangular frame made of a material having a relatively high R value. The frame is closed by a top cover and a bottom cover so that a cavity is established within the panel. The cavity is filled with a curable material that sets inside the panel to bond the walls of the frame together and to bond the covers to the frame. A bulb seal having high insulation characteristics extending along the length of one edge of adjoining panels so that energy transmission is further inhibited.

BRIEF DESCRIPTION OF THE DRAWING

For a further understanding of these and objects of the invention, reference will be made to the following detailed description of the invention which is to be read in connection with the accompanying drawing, wherein.

DETAILED DESCRIPTION OF A PREFERRED EMBODIMENT

The following description of a preferred embodiment is for the purpose of explanation, and not limitation. Some specific details are set forth in order to provide a better understanding of a preferred embodiment of the present invention, however, in other instances, description of other elements, features, and techniques are omitted so as not to encumber or confuse the reader with unnecessary detail. It will be apparent to one skilled in the art that the present invention may be practiced in other embodiments that depart from the following description and that differences may exist from the embodiment specifically described without departing from the spirit and scope of the present invention. The following detailed description is therefore not to be taken in a limiting sense.

Figure 1:
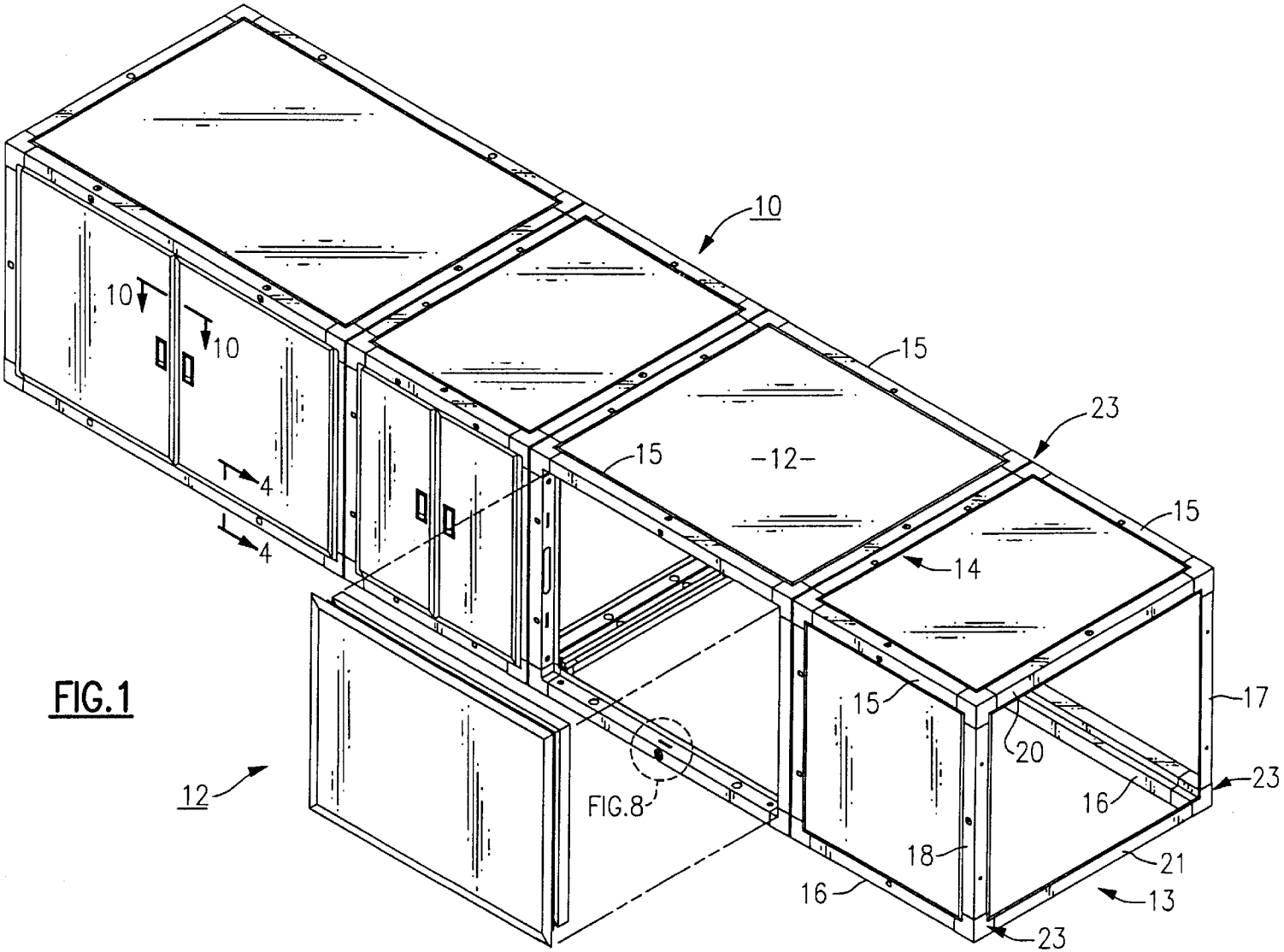
FIG. 1 is a perspective view showing a section of ductwork for conducting air along a desired flow path with a panel shown removed from the support frame of the ductwork.
Figure 2:
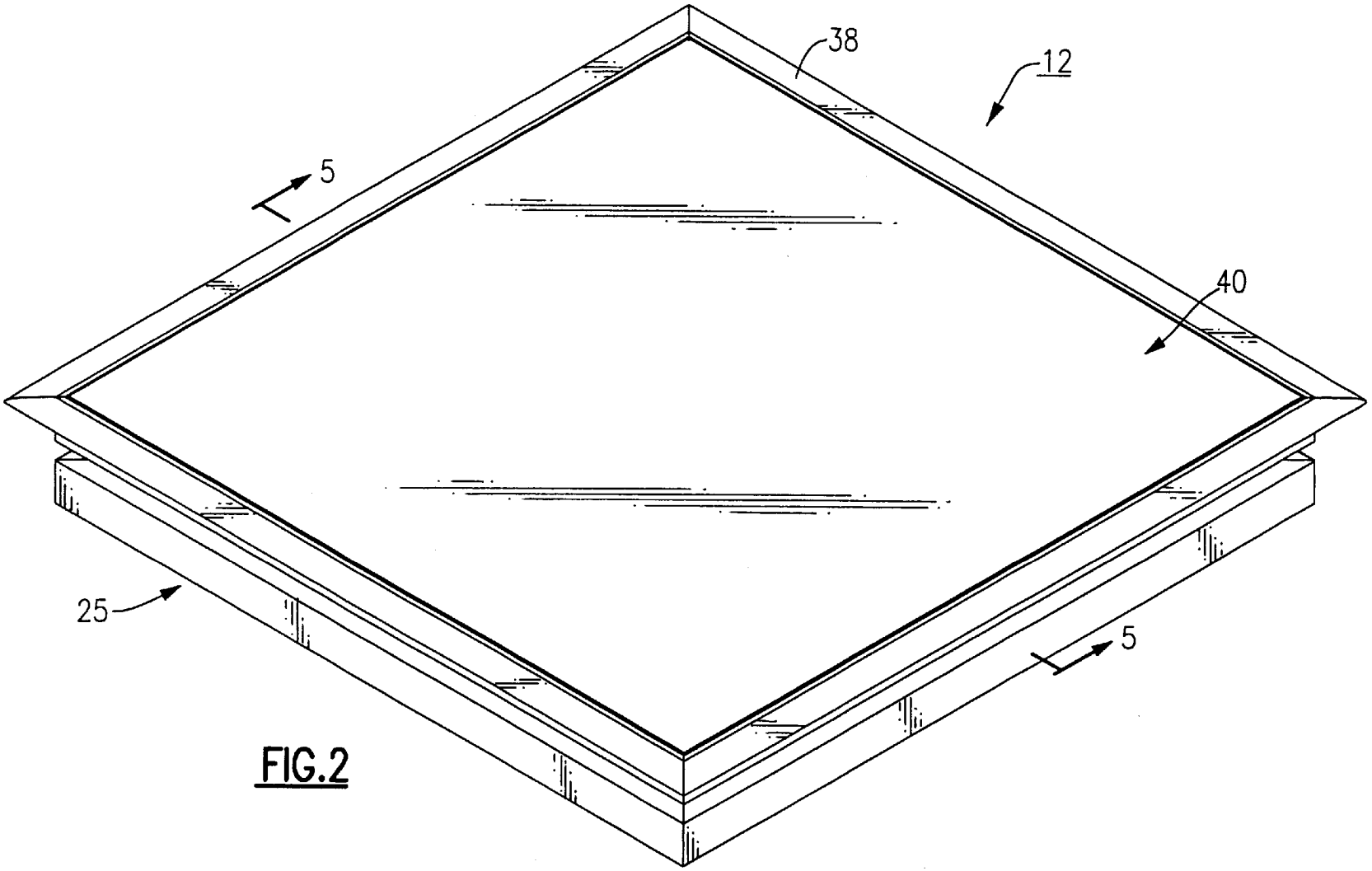
FIG. 2 is an enlarged perspective view of a panel employed to enclose the support frame of the ductwork illustrated in FIG. 1.
Figure 3:
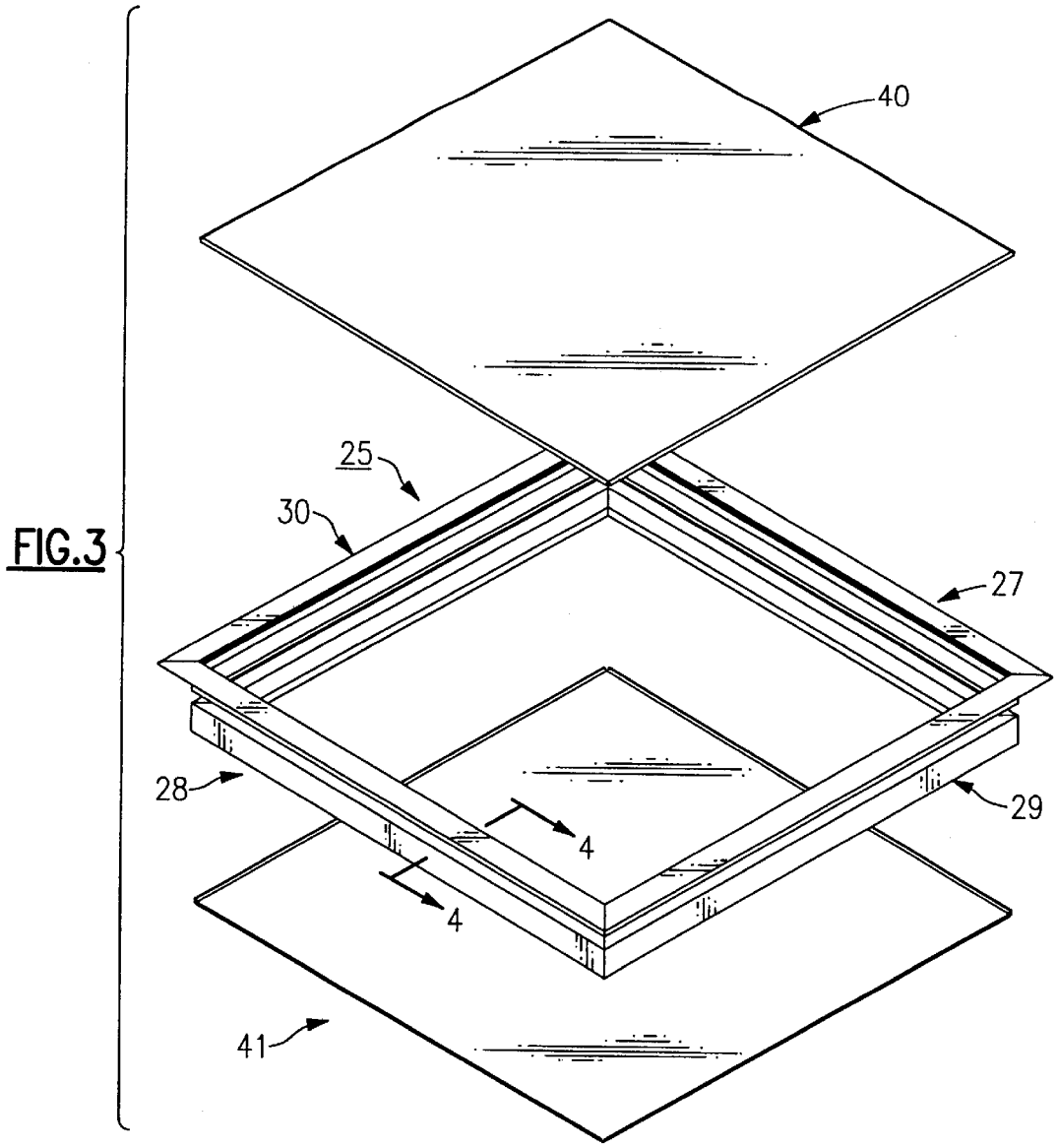
FIG. 3 is an exploded view illustrating the panel frame and covers.

The present invention will be described with reference to the accompanying drawings, wherein like reference numerals refer to the same item. Turning initially to FIG. 1 there is illustrated a section of an air handling unit (AHU), generally referenced 10, that employs wall panels 12 embodying the teachings of the present invention. The air handling unit is composed of a series of rectangular shaped nodules each of which possess a superstructure including a pair of rectangular, planar end frames 13 and 14 that are connected at the corners by a pair of horizontally disposed upper beams 15 and a pair of horizontally disposed lower beams 16. Each end frame includes a pair of opposed side rails 17 and 18 and an upper rail 20 and a lower rail 21. In assembly, the rails and the beams are retained slidably in comer pieces 23. The rails and the beams in assembly thus establish an open skeleton having rectangular openings.

As will be explained in greater detail below, wall panels embodying the teachings of the present invention can be placed in the skeleton openings to close the AHU sections. Each panel is constructed so that it has an extremely high insulation value, thus greatly impeding the flow of heat into or out of the unit which, in turn, prevents the unit from sweating.

Figure 4:
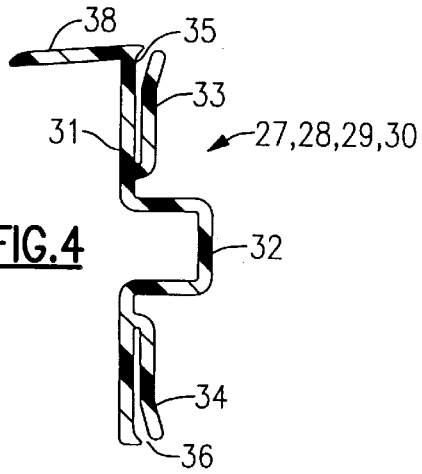
FIG. 4 is an enlarged sectional view of the panel frame taken along line 4—14 in FIG. 3.

With further reference to FIGS. 2–5, each panel 12 includes a rectangular frame 25 having a pair of opposed side walls 27 and 28 and a pair of opposed end walls 29 and 30. Each wall contains mitered ends so that the walls can be brought together to form right angle comers. Each wall is molded of a plastic material having a high insulation value. As best illustrated in FIG. 4, each wall contains a vertically disposed wall partition 31 having a rectangular shaped recess 32 formed centrally therein that extends along the length of the partition. The recess 32 is inwardly disposed with reference to the outer surface of the partition 31. An upper tab 33 and a lower tab 34 are integrally molded on the inside of the partition 31 on either side of the recess 32. The tabs 33, 34, like the recess 32, extend along the length of the wall. The tabs 33, 34 run parallel to the partition 31 and coact therewith to form narrow channels 35 and 36. The upper channel 35 opens towards the top of the wall while the lower channel 36 opens toward the bottom of the wall. A flange 38, which is integral with the wall partition 31, runs along the top edge of the partition 31. The flange 38 extends outwardly from the wall partition 31 and forms an angle that is slightly less than 90° with the partition 31 so that the flange 38 extends downwardly at a slight angle from the top edge of the partition.

Figure 5:
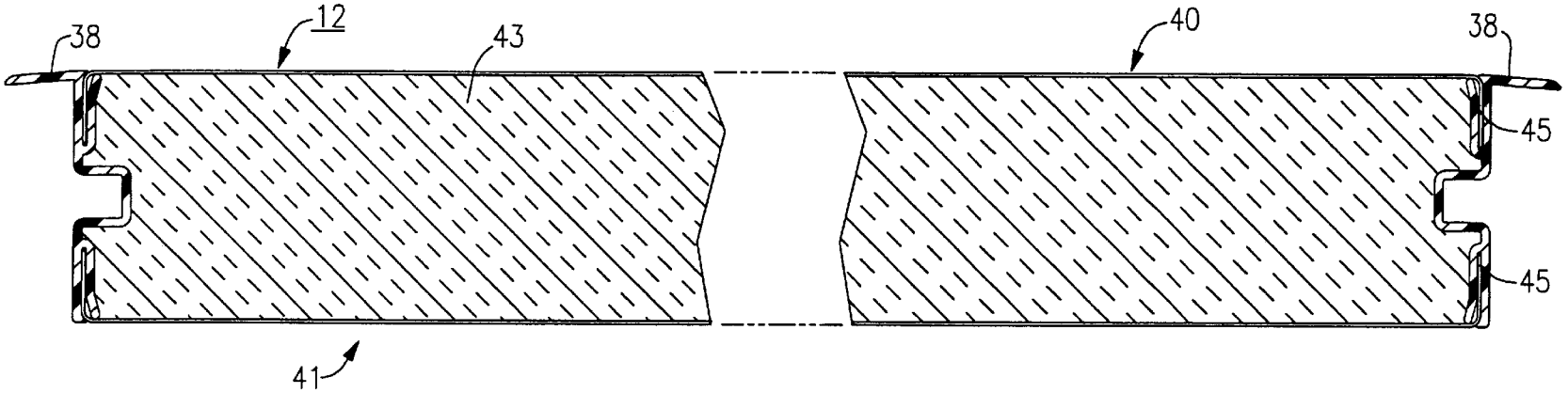
FIG. 5 is an enlarged sectional view of the panel assembly taken along lines 5—5 in FIG. 2.

As illustrated in FIG. 5, a top cover 40 and a bottom cover 41 are used to close the frame and create a cavity inside the panel. Each cover 40, 41 contains an inwardly directed skirt 45 that depends downwardly from the cover and extends around the entire periphery of the cover. In assembly, the skirts 45 are inserted into the upper and lower channels that encircle the panel frame. A curable foam 43 is injected into the cavity to entirely fill the cavity with the foam. When the foam cures, it bonds the frame walls together in abating contact and bonds the covers to the frame. Preferably, the curable foam is a polyurethane material which like the panel frame walls has a high insulation value.

Each panel is sized so that the panel frame can be slipped into an opening in one of the unit sections. A close sliding fit is provided between panel frame walls and the side rails and upper and lower beams that form the receiving opening. When the panel is fully received within the opening, the flange 38 that surrounds the panel frame is compressed against the outer surfaces of the rails and beams forming the opening.

Figure 6:
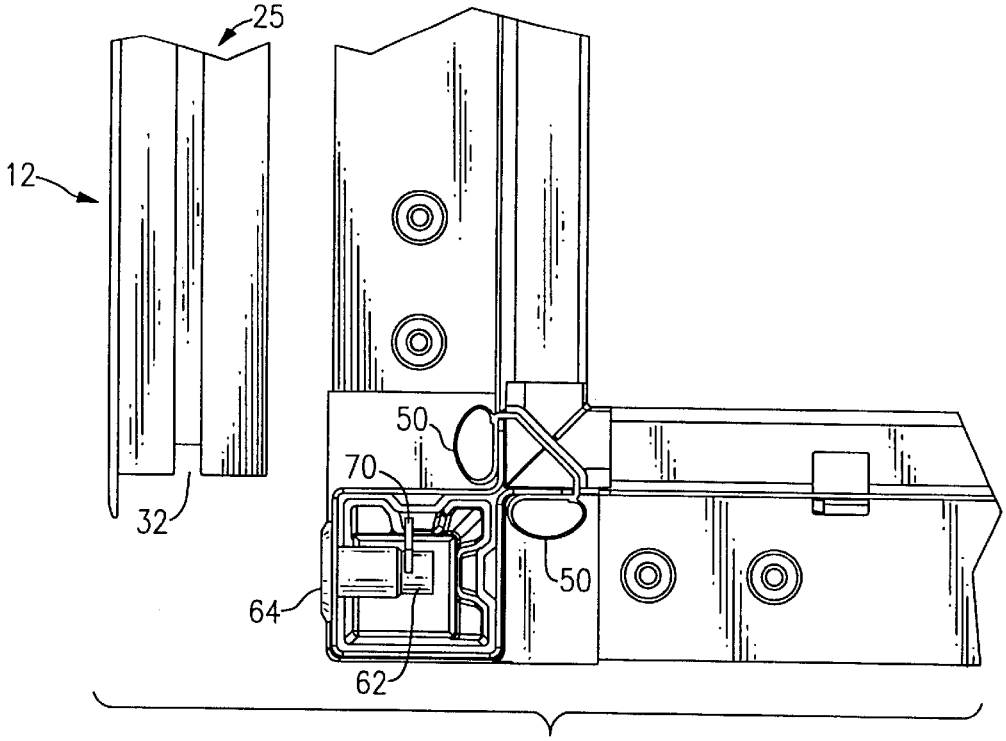
FIG. 6 is an enlarged partial view showing a corner section of the ductwork skeleton with one panel removed from the duct work.
Figure 7:
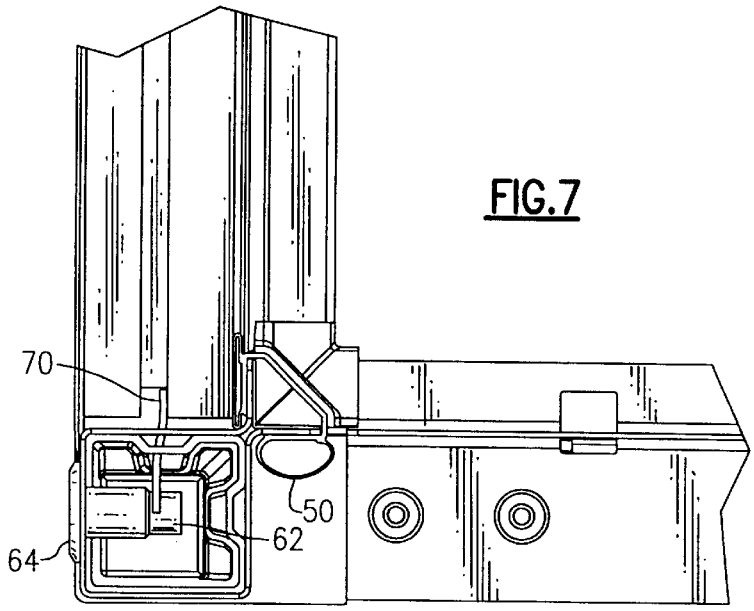
FIG. 7 is a view similar to FIG. 6 showing the panel locked to the ductwork skeleton.

As illustrated in FIGS. 6 and 7, compressible hollow seals 50 are preferably mounted around the panel receiving opening. At panel closure, the lower cover 41 of the panel compresses the seals as shown in FIG. 7 to prevent air inside the unit from escaping around the panel.

Figure 8:
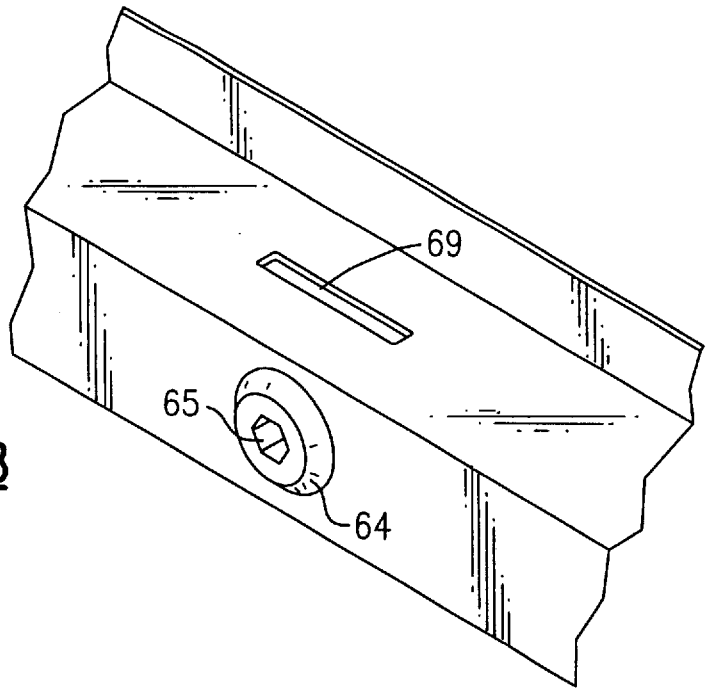
FIG. 8 is an enlarged view showing the latching mechanism for locking a panel to the ductwork skeleton in a retracted position.
Figure 9:
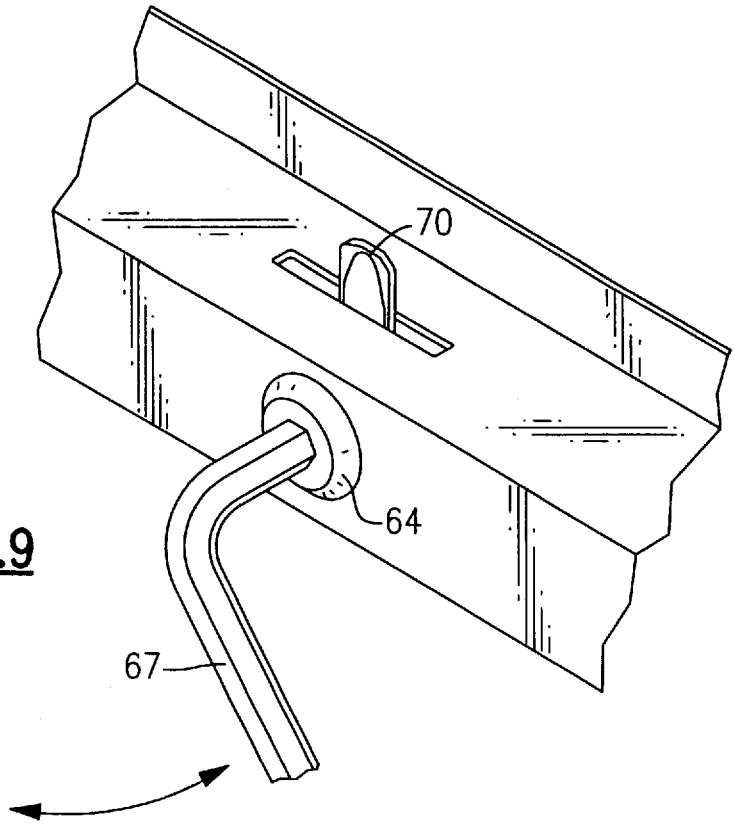
FIG. 9 is similar to FIG. 8 showing the latching mechanism in a raised locking position.

The panels are held in a closed position by a series of latching mechanisms that are mounted inside the rails and the beams surrounding each opening. Preferably, the rails and the beams are square metal tubes that are slidably retained in the corner pieces. Each latching mechanism includes a cylindrical tumbler 62 that is retatchably contained within the tube. The tumbler contains an outer flange 64 (see FIGS. 8 and 9) that has a six sided slot 65 that passes inwardly through the flange. An Allen wrench 67 is insertable into the slot and is used to turn the tumbler between an open position and a locking position. An elongated arm 70 is secured to the tumbler that is arranged to pass upwardly through a slotted hole 69 in the containing tube as the tumbler is turned from an open position as illustrated in FIG. 8 to a locking position as illustrated in FIG. 9. The arm 70 is arranged to pass into the recess 32 surrounding the panel frame and to force the panel into sealing contact against the seals 50 surrounding the panel receiving opening as shown in FIG. 7. Preferably, at least one latching mechanism is employed to engage each of the walls making up the panel frame 25.

Figure 10:
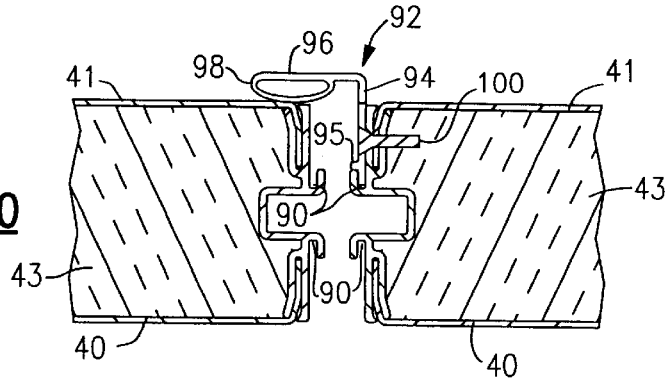
FIG. 10 is an enlarged sectional view of the panel assembly taken along the lines 10—10 in FIG. 1.

There is shown in FIG. 10 a partial sectional view of two panels oriented in a side-by-side arrangement along the framework. Each of the panels is essentially identical to the panels previously described, in addition, each peripheral wall of the panel facing the peripheral wall of the adjacent panel possesses a generally U-shaped groove 90 associated with the channel. As best shown in FIG. 10, each groove 90 extends generally parallel to an associated one of the channels in the wall and is disposed peripherally outwardly from the associated channel. Also, the depth of each groove 90 is substantially shorter than the depth of the associated channel, approximately one-quarter to one-half of the depth of the associated channel. Preferably each groove 90 is formed by integrally molding the groove 90 with the wall.

Figure 11:
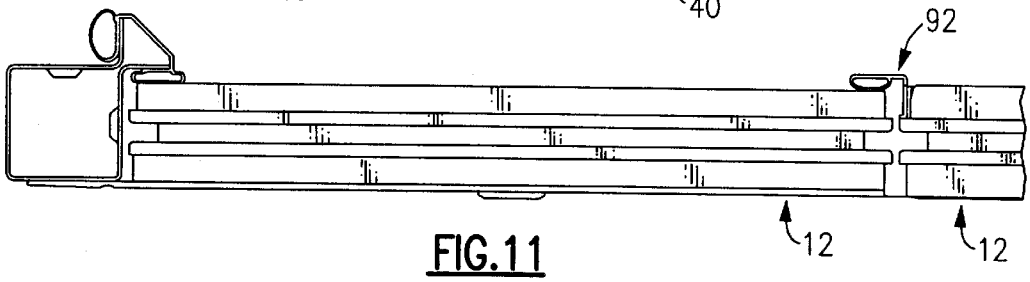
FIG. 11 is a top schematic illustration of the panel assembly in the left-most region of the ductwork shown in FIG. 1 with the panels oriented in a side-by-side arrangement along the ductwork frame.

In the embodiment shown in FIG. 10, at least one of the panels includes a substantially L-shaped bar 92 having a first leg 94 adapted to abut an associated one of the channels and to extend into the associated groove 90. The first leg 94 includes a leg or boss 95 adapted to abut the upper edge of the associated groove 90 and is adapted to act as a stop. The L-shaped bar 92 also includes a second leg 96 which preferably possesses a resiliently deformable bulbous section 98 adapted to compressably, sealingly abut with the cover of an adjacent panel, as best shown in FIGS. 10 and 11. Preferably, the bulbous section 98 is fashioned in a tubular configuration having a hollow core. It should be appreciated that the second leg 96 may possess deformable and resiliently deformable configurations other than a bulbous shape. Also, the remaining portion of the L-shaped bar 92, other than the bulbous section 98, is preferably rigid, and preferably the entire L-shaped bar 92 is fashioned as a dual durometer bulb seal. Preferably the L-shaped bar 92 extends along the entire length of the interface between the two opposing walls of adjacent panels.

As best shown in FIGS. 10 and 11, the bulbous section 98 substantially prevents air from flowing between the interior and the exterior of the duct, that is, prevents air from flowing through the region between the opposing walls adjacent panels.

Figure 12:
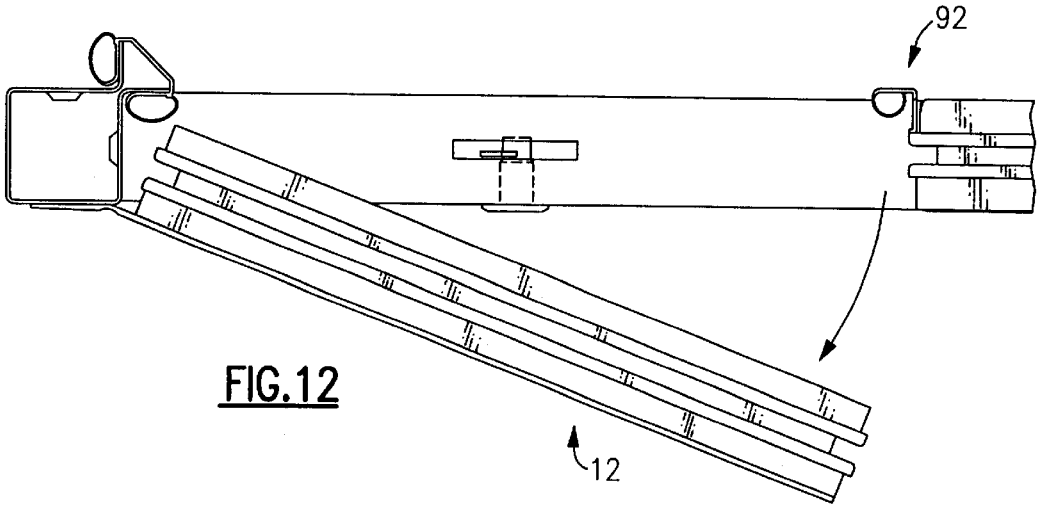
FIG. 12 is a schematic illustration similar to that shown in FIG. 11 with one of the panels hingedly mounted to the frame and rotatably extending in an open position relative to the frame.
Figure 13:
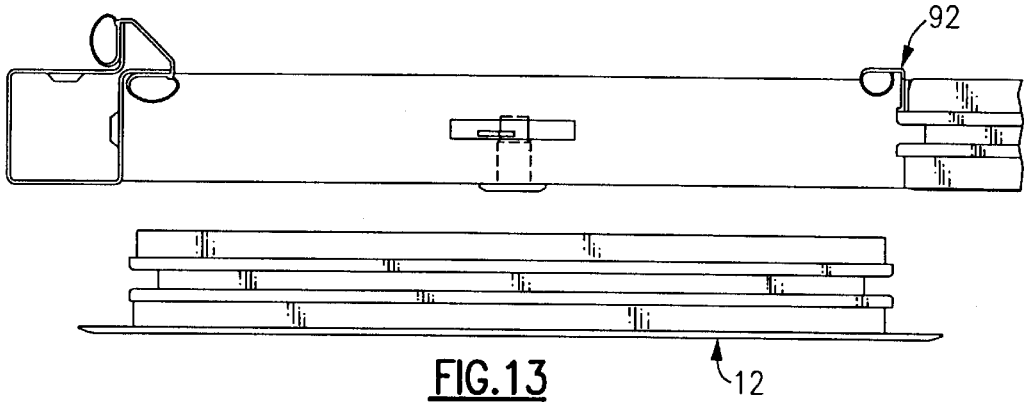
FIG. 13 is a schematic illustration similar to FIG. 11 showing an unhinged panel removeably positioned away from the frame.

In a non-deformed, rest state, the bulbous section 98 preferably possesses a substantially elliptical cross-section, as best shown in FIGS. 12 and 13. Although the bulbous section 98 is preferably tubular and possesses a hollow core, with open ends, the present invention contemplates that the bulbous section may be tubular with closed ends and may be filled with a fluid. Also, the core of the bulbous section 98 may be filled with a deformable solid such as a foam rubber or other elastomer. Also, the bulbous section 98 may not have any core section, but rather, may be fashioned from a unitary piece of material such as a foam rubber or other elastomer. In addition, the bulbous section 98 may be fashioned of a material that is discrete from the material from which the remainder of the L-shaped bar 92 is fashioned, and for example, the bulbous section 98 may be adhered to or otherwise secured to the remaining portion of the L-shaped bar 92.

The L-shaped bar 92 may be releasably fastened to the associated panel by the provision of a screw 100 extending through the first leg 94 of the L-shaped bar 92, through the associated channel and cover skirt, and into the foam insulation, as best shown in FIG. 10. Although the L-shaped bar 92 is mounted to the wall of the associated panel by the insertion of the first leg 94 into the associated groove 90 and by the screw 100, it is within the scope of the present invention that other designs may also be used effectively, such as integrally forming the L-shaped leg 92 with the wall, adhering the L-shaped leg 92 to the wall, and clipping the L-shaped bar 92 to the wall. Alternatively, in utilizing L-shaped bar 92, the first leg 94 may extend substantially parallel to the second leg 96, with the second leg mounted on the cover 41 of the associated panel. It should be appreciated that although the L-shaped bar 92 is preferably selectively, releasably mounted to the associated panel, it is within the scope of the invention that the bar 92 may be fixedly mounted to the panel.

As shown in FIG. 12, one of the adjacent panels may be hingedly mounted to the skeletal framework of the duct and may be rotated between and open and closed position. In an alternative embodiment, one of the panels may be non-hingedly mounted to the skeletal framework, as shown in FIG. 13, and may be selectively mounted and/or removed from the skeletal framework. It should be appreciated that in either of the embodiments in FIGS. 12 and 13, the latching mechanism previously described may be employed.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. A panel for use in an air handling duct substantially defining an interior space for conducting air along an enclosed flow path and an exterior, said panel including a peripheral wall having a top edge and a bottom edge, said peripheral wall including an upper channel opening to the top edge of said wall and a lower channel opening to the bottom edge of said wall, said channel extending along substantially the entire length of said wall, said wall further including an upper groove opening to the top edge of said wall and a lower groove opening to the bottom edge of said wall, a top cover and a bottom cover, each cover having a periphery and an associated skirt extending about the periphery thereof and the skirt of the top cover being contained within the upper channel of said wall and the skirt of the bottom cover being contained within the lower channel of said wall to establish an enclosed cavity within the panel; and a substantially L-shaped bar, a first leg of which is contained within the lower groove of said wall, and a second leg of which possesses a deformable bulbous section adapted to compressively, sealingly abut another portion of the air handling duct such that air is substantially prohibited from passing between the interior space within said air handling duct and the exterior of the air handling duct.

2. The panel of claim 1 wherein each cover is formed of metal and the associated skirt is integral with each cover.

3. The panel of claim 1 wherein said cavity is substantially completely filled with a curable foam material that is injected into the cavity and which when cured bonds said wall and said covers together.

4. The panel of claim 1 further including a flat flange extending outwardly from the top peripheral edge of each wall such that said flange abuts the top edge of the frame.

5. The panel of claim 1 further including a screw extending through said first leg, said wall, and one of said skirts.

6. The panel of claim 1 wherein said bar is fashioned substantially of plastic and wherein said first leg is substantially rigid.

7. The panel of claim 1 wherein said bulbous section possesses a tubular configuration having a hollow core.

8. The panel of claim 7 wherein said bulbous section possesses a substantially elliptical cross sectional shape in an undeformed state.

9. The panel of claim 1 wherein said upper groove is substantially parallel to said upper channel and said lower groove is substantially parallel to said lower channel.

10. The panel of claim 9 wherein said upper groove is disposed substantially peripherally outwardly from said upper channel and said lower groove is disposed substantially peripherally outwardly from said lower channel.

11. An air handling duct for conditioning air along an enclosed flow path, said duct including a skeletal framework and at least two substantially identical panels oriented in a substantially side-by-side arrangement and mounted along said skeletal framework, each panel including a substantially planar inner surface and a substantially planar outer surface and a peripheral wall extending substantially between said surfaces, at least one of said panels including an associated substantially L-shaped bar, a first leg of which is mounted proximate to said wall and a second leg of which possesses a deformable bulbous section adapted to compressively, sealingly abut the inner surface of said at least one other substantially identical panel when such that air is substantially prohibited form passing between said panels when said panels are so oriented.

12. The air conditioning duct of claim 11 wherein said at least one panel further includes means for releasably securing said first leg to said wall.

13. The air conditioning duct of claim 12 wherein said releasably securing means includes a groove integrally formed with said wall and adapted to receive said first leg.

14. The air conditioning duct of claim 12 wherein said releasably securing means includes a screw extending through said first leg and said wall.

15. The air conditioning duct of claim 11 wherein said bar is fashioned substantially of plastic and wherein said first leg is substantially rigid.

16. The air conditioning duct of claim 11 wherein said bulbous section possesses a tubular configuration having a hollow core.

17. The air conditioning duct of claim 16 wherein said bulbous section possesses an elliptical cross sectional shape in an undeformed state.

18. The air conditioning duct of claim 11 wherein at least one of said panels is hingedly mounted on said skeletal framework.

19. An air handling duct for conditioning air along an enclosed flow path, said duct including a skeletal framework and at least two substantially identical panels oriented in a substantially side-by-side arrangement and mounted along said skeletal framework, each panel including a substantially planar inner surface and a substantially planar outer surface and aperipheral wall extending substantially between said surfaces, at least one of said panels including an associated bar possessing at least two legs, a first leg of which is mounted proximate to said wall and a second leg of which possesses a deformable section adapted to compressively, sealingly abut the inner surface of said at least one other substantically identical panel such that air is substantially prohibited form passing between said panels when said panels are so oriented.

20. The air conditioning duct of claim 19 wherein said at least one panel further includes means for releasably securing said first leg to said wall.

21. The air conditioning duct of claim 20 wherein said releasably securing means includes a groove integrally formed with said wall and adapted to receive said first leg.

22. The air conditioning duct of claim 20 wherein said releasably securing means includes a screw extending through said first leg and said wall.

23. The air conditioning duct of claim 19 wherein said bar is fashioned substantially of plastic and wherein said first leg is substantially rigid.

24. The air conditioning duct of claim 19 wherein at least one of said panels is hingedly mounted on said skeletal framework.

* * * * *

UNITED STATES PATENT AND TRADEMARK OFFICE

CERTIFICATE OF CORRECTION

PATENT NO. : 6,497,256 B1 
DATED : December 24, 2002
INVENTOR(S) : John C. Adams, Michael W. Austin and Christian C. Herbeck It is certified that error appears in the above-identified patent and that said Letters Patent is hereby corrected as shown below:

Column 6,
Line 62, after the word "panel", please delete the word "when" and
Line 63, after the word "prohibited", please delete the word "form" and replace with the word -- from --.

Column 8,
Line 7, after the word "prohibited", please delete the word "form" and replace with the word -- from --.

Signed and Sealed this

Twenty-ninth Day of April, 2003

JAMES E. ROGAN
*Director of the United States Patent and Trademark Office*